343-700 MS AU 254 EX
8/31/82 OR 4,347,517

United States Patent [19]

Kaloi

[11] 4,347,517

[45] Aug. 31, 1982

[54] MICROSTRIP BACKFIRE ANTENNA

[75] Inventor: Cyril M. Kaloi, Thousand Oaks, Calif.

[73] Assignee: The United States of America as represented by the Secretary of the Navy, Washington, D.C.

[21] Appl. No.: 228,429

[22] Filed: Jan. 26, 1981

[51] Int. Cl.[3] ..... H01Q 1/38; H01Q 19/12

[52] U.S. Cl. ..... 343/700 MS; 343/840

[58] Field of Search ..... 343/700 MS, 840, 824, 343/830, 846

[56] References Cited

U.S. PATENT DOCUMENTS

| | | | |
|---|---|---|---|
| 3,947,850 | 3/1976 | Kaloi | 343/795 |
| 3,972,049 | 7/1976 | Kaloi | 343/829 |
| 3,978,488 | 8/1976 | Kaloi | 343/829 |
| 3,984,834 | 10/1976 | Kaloi | 343/700 MS |
| 4,040,060 | 8/1977 | Kaloi | 343/700 MS |
| 4,051,478 | 9/1977 | Kaloi | 343/700 MS |
| 4,067,016 | 1/1978 | Kaloi | 343/700 MS |
| 4,078,237 | 3/1978 | Kaloi | 343/700 MS |
| 4,095,227 | 6/1978 | Kaloi | 343/700 MS |
| 4,117,489 | 9/1978 | Kaloi | 343/700 MS |
| 4,125,839 | 11/1978 | Kaloi | 343/700 MS |
| 4,142,190 | 2/1979 | Kerr | 343/840 |
| 4,291,312 | 9/1981 | Kaloi | 343/700 MS |

*Primary Examiner*—David K. Moore

*Attorney, Agent, or Firm*—Robert F. Beers; Joseph M. St. Amand

[57] ABSTRACT

A microstrip backfire antenna which combines the microstrip type antenna element with a backfire cavity to provide more than three times the gain over a single microstrip element and thereby be capable of replacing four or more elements of a conventional microstrip array. The microstrip backfire antenna consists of a microstrip element in a cavity between a total reflector and a partial reflector and is characterized by multiple reflections of electromagnetic waves between the two reflectors and by energy being radiated normal to and through the partial reflector.

22 Claims, 13 Drawing Figures

MICROSTRIP BACKFIRE ANTENNA

BACKGROUND

This invention relates to microstrip antennas and more particularly to a multi-mode antenna using both microstrip antenna elements and a backfire cavity.

Compact missile-borne antenna systems require complex antenna beam shapes. At times, these beam shapes are too complex to obtain with a single antenna type, such as slots, monopoles, microstrip, etc., and require a more expensive phased array.

A less expensive approach can be realized in a multi-mode antenna incorporating two or more antenna types into one single new antenna configuration, and using the radiation pattern of each antenna type to provide a desired new and unique combined radiation pattern. This requires techniques for exciting two or more antenna modes with one single input feed and also for controlling the excitation of the mode of each antenna type in order to better shape the pattern.

SUMMARY OF THE INVENTION

A microstrip backfire antenna configuration combines the microstrip type antenna element with a backfire cavity. This new combination, depending on the various antenna parameters, can provide more than three times the gain over a single microstrip element and thereby be capable of replacing four or more elements of a conventional microstrip array. The microstrip backfire antenna of this invention consists of placing a microstrip element between a total reflector and a partial reflector (i.e., in a Fabray Perot Cavity). This antenna is characterized by multiple reflections of electromagnetic waves between the two reflectors and by the energy being radiated normal to and through the partial reflector. The microstrip element can also be placed coplanar with the total reflector. In this antenna, near symmetry is provided in both the E and H plane patterns.

DESCRIPTION OF THE PREFERRED EMBODIMENTS

While a rigorous theory for the microstrip backfire antenna has not been developed, experimental studies have provided an insight into the effects of the more important parameters and have allowed judicious selection of these parameters in designing several different types of microstrip backfire antenna with varying performance characteristics.

Figure 1A:
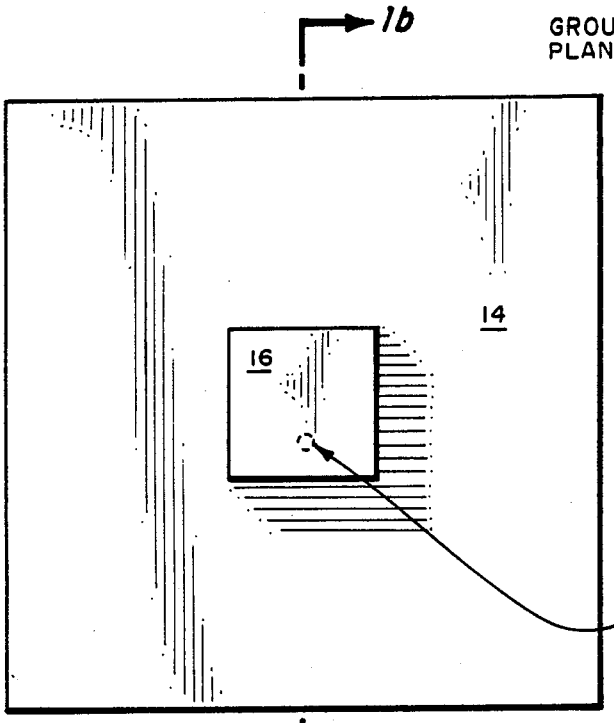
FIG. 1*a* shows a planar schematic view of a microstrip backfire antenna using a typical square microstrip element.
Figure 1B:
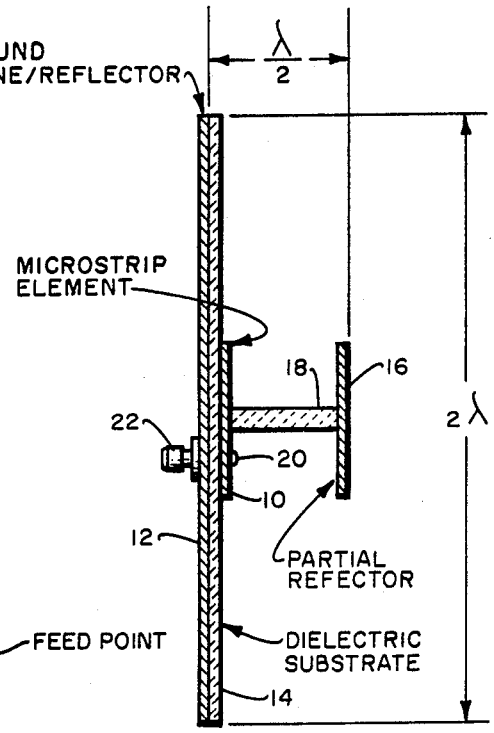
FIG. 1*b* shows a cross-sectional view of the antenna of FIG. 1*a* taken along section line 1*b*—1*b*.

FIGS. 1*a* and 1*b* show a microstrip backfire antenna using a typical square microstrip element. A microstrip radiating element 10 is mounted above and spaced from a ground plane 12 by a dielectric substrate 14, as in a typical microstrip antenna. A partial reflector 16 is mounted above radiating element 10 parallel to and approximately one-half wavelength (i.e., $\lambda/2$) from ground plane 12. In this configuration, the ground plane plate 12 also serves as the total reflector to form a backfire cavity with partial reflector 16. The partial reflector 16 is approximately the same size as the microstrip radiating element 10 and the shape of both reflectors (12 and 16) are made square to provide symmetry with the microstrip element. Partial reflector 16 is supported above radiating element 10 by means of a central support 18, for example. Support 18 is of any suitable dielectric material, and may be a means other than a central post as shown. Various types of suitable supports can be used, but their effect on the total antenna design must be taken into consideration. The cavity formed by the space between the total reflector and the partial reflector can be air, or filled with a dielectric material (such as shown in FIG. 7*b*). However, where a dielectric substrate is used to support the partial reflector, the effect of the dielectric on the total antenna design must be taken into consideration. Where the cavity is filled with a dielectric, the spacing between the total reflector and the partial reflector should be approximately one-half the wavelength in the dielectric. Feed point 20 on radiating element 10 is connected to and fed from a coaxial connector 22 mounted on the ground plane side.

Figure 2A:
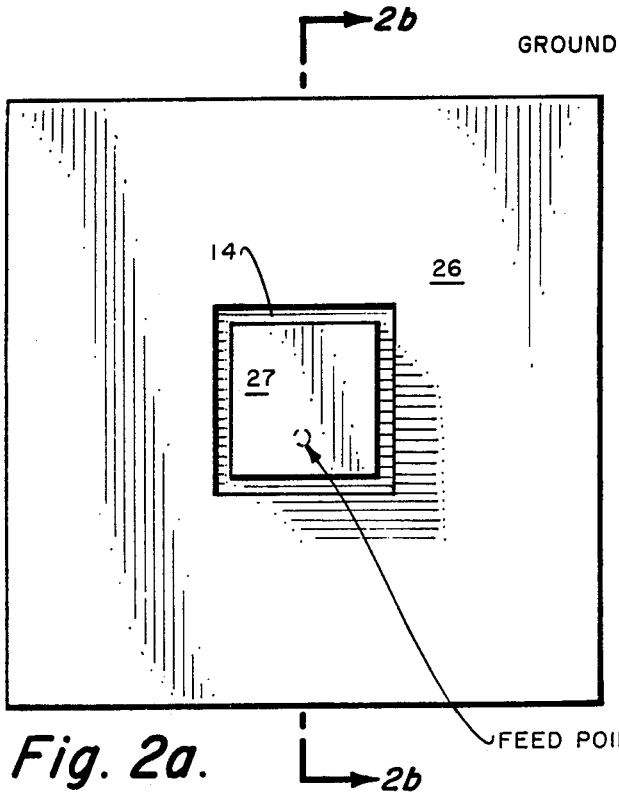
FIG. 2*a* shows a planar view of a microstrip backfire antenna with the total reflector coplanar with the square microstrip element.
Figure 2B:
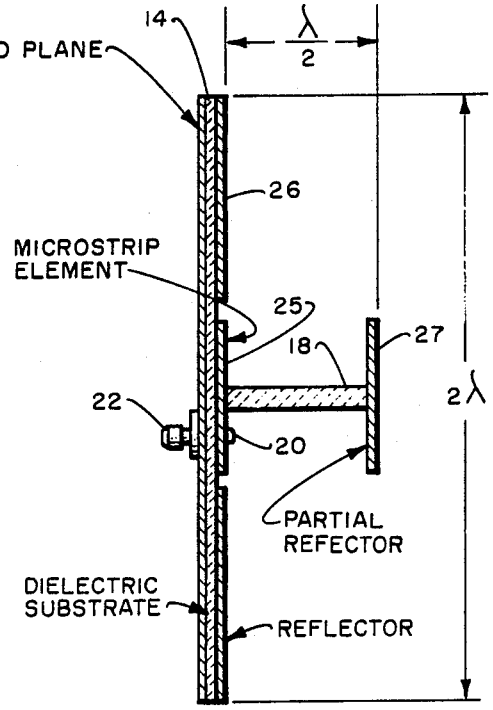
FIG. 2*b* shows a cross-sectional view of the antenna of FIG. 2*a* taken along section line 2*b*—2*b*.

FIGS. 2*a* and 2*b* show a microstrip backfire antenna using a square coplanar microstrip radiating element 25. In this configuration, the total reflector 26 is coplanar with the microstrip element 25. The partial reflector 27 is approximately the same size as the radiating element 25 and the shape of both reflectors are made square to provide symmetry with the microstrip element. This configuration provides more gain (approximately 1 db) than the configuration in FIGS. 1*a* and 1*b*, and this is due to the total reflector 26 being coplanar with the microstrip radiating element 25 thus providing a more consistent reflection plane.

Figure 3A:
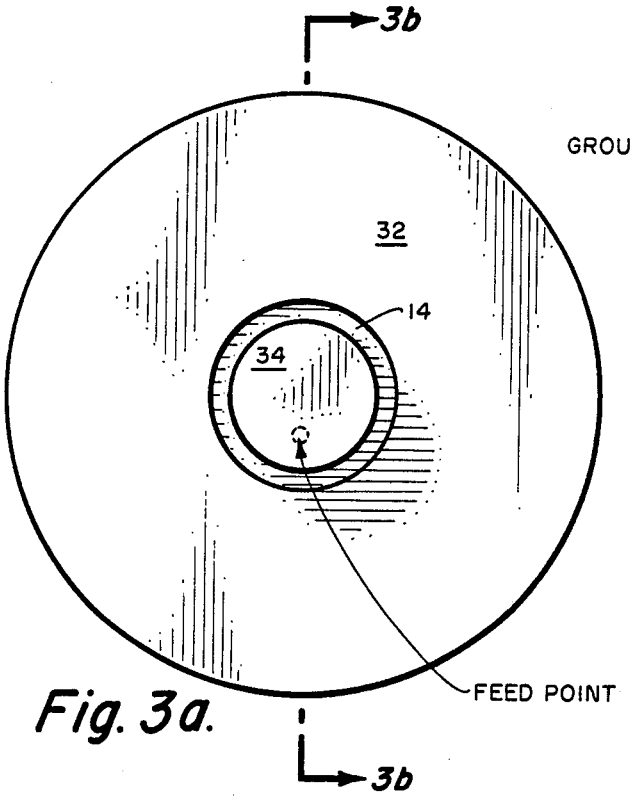
FIG. 3*a* is a planar view of a microstrip backfire antenna using a circular coplanar microstrip element and circular reflectors.
Figure 3B:
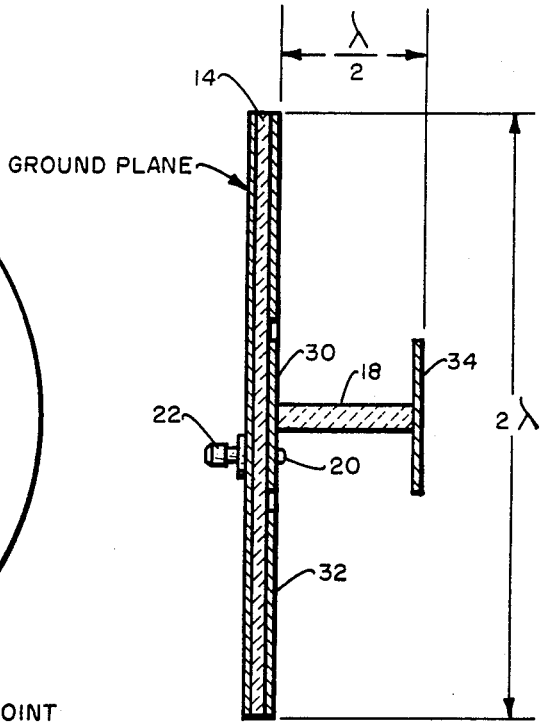
FIG. 3*b* is a cross-sectional view taken along section line 3*b*—3*b* of FIG. 3*a*.

FIGS. 3*a* and 3*b* show a microstrip backfire antenna using a circular coplanar microstrip radiating element 30. In this configuration, the total reflector 32 is coplanar with the microstrip radiating element 30. The partial reflector 34 is approximately the same size as the microstrip radiating element 30 and both reflectors are made circular to provide symmetry with the microstrip radiating element. This configuration appears to provide approximately the same gain as the configuration shown in FIGS. 2*a* and 2*b*.

Figure 4A:
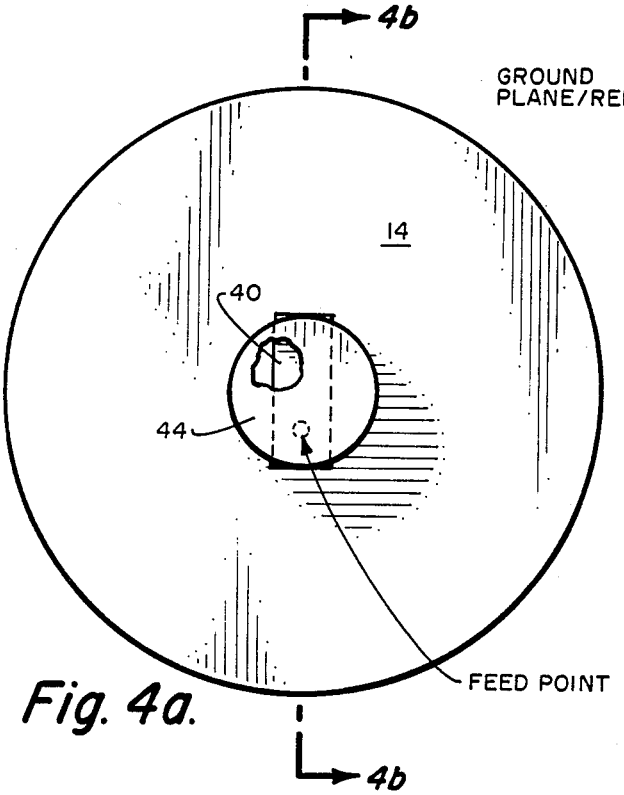
FIG. 4*a* is a planar view of a microstrip backfire antenna using a rectangular microstrip element and circular reflectors.
Figure 4B:
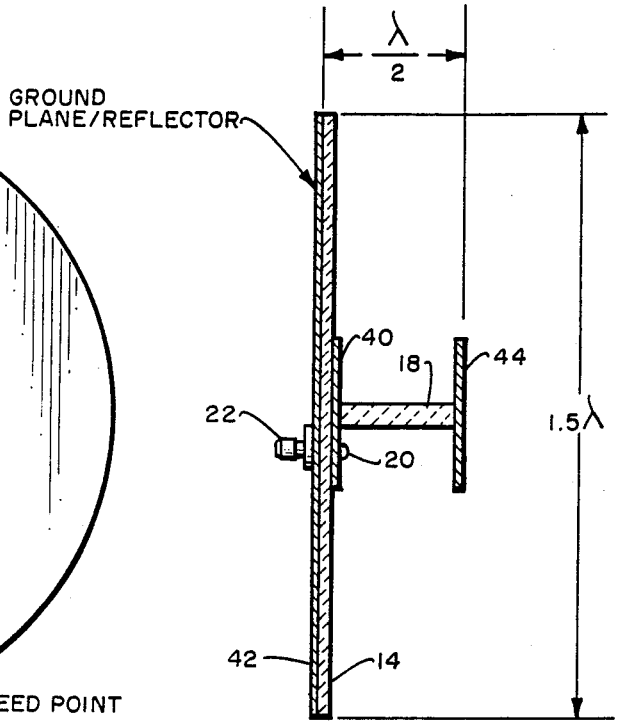
FIG. 4*b* is a cross-sectional view taken along section line 4*b*—4*b* of FIG. 4*a*.

FIGS. 4*a* and 4*b* show a microstrip backfire antenna using a typical rectangular microstrip radiating element 40. In this configuration the ground plane plate 42 also serves as the total reflector, as in FIGS. 1*a* and 1*b*. The partial reflector 44 and the total reflector, i.e. 42, are both circular. As can be seen from the drawings, the length of the microstrip radiating element 40 is approximately equal to the diameter of the partial reflector 44. This configuration provides the least gain of all the configurations previously discussed. The main reason for this decrease in gain is the lack of symmetry between the rectangular microstrip radiating element 40 and the circular reflectors 42 and 44, and inconsistent reflection planes.

Various types and shapes of microstrip radiating elements can be used, both electric and magnetic, such as disclosed in U.S. Pat. Nos. 3,947,850; 3,972,049; 3,978,488; 3,984,834; 4,040,060; 4,051,478; 4,067,016; 4,078,237; 4,095,227; 4,117,489; and 4,125,839, for example. However, as already discussed herein, it is preferred that there be symmetry between the radiating element and both reflectors in order to provide for optimum gain. The microstrip radiating elements can also be fed from transmission lines photoetched along with the radiating element; however, any effect the microstrip transmission lines may have on total antenna design must be considered. While reflectors of other shapes, such as rectangular or elliptical, can also be used, the radiation patterns will not be as uniform and optimum gain will not be achieved.

The parameters that provide control for obtaining optimum operation conditions for the microstrip backfire antenna are the partial reflector and total reflector diameters, the partial reflector and total reflector separation, symmetry between the microstrip radiating element and the reflectors, parallel and consistent reflection planes, and matching of the microstrip radiating element to the backfire cavity formed by the space between the partial reflector and the total reflector.

The diameter of the total reflector appears to have a more direct influence on the gain. Most of the measurements made on the backfire antennas have been on total reflectors having diameters of approximately one and one-half wavelength, i.e., 1.5λ. With a reflector diameter of 1.5λ for the total reflector, a gain of approximately 11 db is obtained with a circular radiating element and circular coplanar reflectors. It was found that the gain will increase to a maximum of approximately 13 db for total reflectors having a larger diameter, with no substantial gain for total reflectors having a diameter greater than 2λ. Decreasing the diameter of the total reflectors to approximately 1λ would reduce the gain to approximately 7 db.

The diameter of the partial reflector in most backfire antenna designs used was made approximately equal to the length and/or diameter of the microstrip radiating element, and optimum adjustment of the length/diameter dimension was made to provide increased gain. Higher order modes can occur in the radiating element if the width is made greater than the length. While this is usually undesirable, there are occasions that higher order modes are useful.

The separation between the total reflector and the partial reflector was approximately λ/2. Optimum adjustment of the separation along with optimum matching of the microstrip element was made on most designs to provide gain and VSWR.

Figure 5:
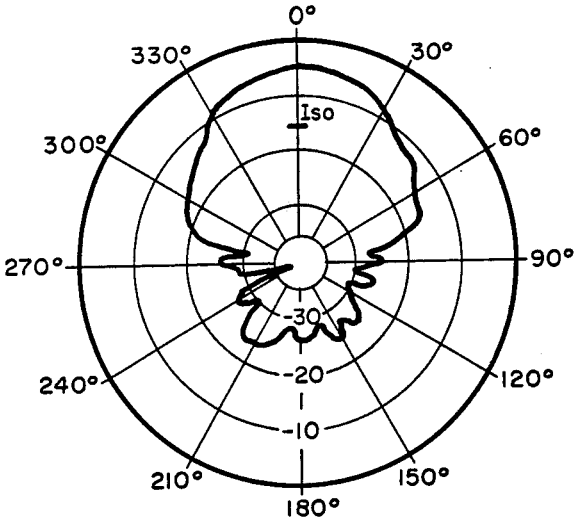
FIG. 5 shows a radiation pattern plot of the microstrip backfire antenna shown in FIGS. 3*a* and 3*b*.
Figure 6:
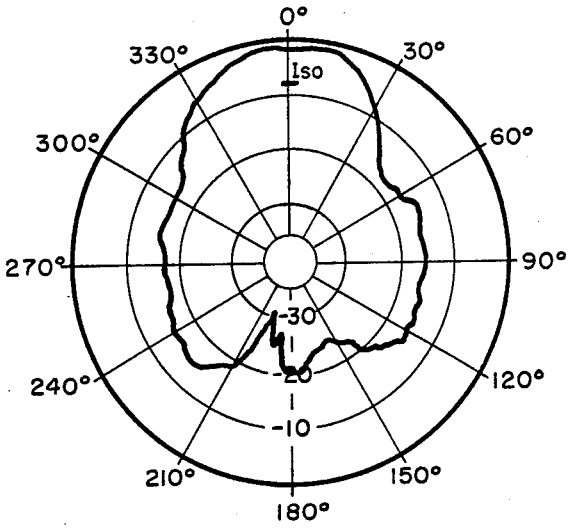
FIG. 6 shows a radiation pattern plot of the microstrip backfire antenna shown in FIGS. 4*a* and 4*b*.

FIG. 5 shows a radiation pattern plot of the microstrip backfire antenna shown in FIGS. 3*a* and 3*b*. FIG. 6 shows a radiation pattern plot of the microstrip backfire antenna shown in FIGS. 4*a* and 4*b*. The total reflector diameter for the radiation pattern shown in FIG. 6 was approximately 1.5λ, whereas for the radiation pattern shown in FIG. 5 the total reflector had a diameter of 2λ. Some difference in gain between FIG. 5 and FIG. 6 can also be attributed to the nonsymmetry between the microstrip radiating element 40 and reflectors 42 and 44 in FIGS. 4*a* and 4*b*, and the symmetry between the coplanar microstrip radiating element and the reflectors in FIG. 3*a* and 3*b*.

The microstrip backfire antenna can be used as a single element in an efficient array. As such, one microstrip backfire antenna can take the place of four or more microstrip radiating elements and provide overall thinning of an array. In this mode, the number of feed elements is reduced without suffering significant loss in directivity or pattern quality, the insertion losses due to additional transmission lines are reduced because fewer elements are used, the complexity is reduced because fewer feed systems are required, and the construction cost is decreased because less material is used.

Figure 7A:
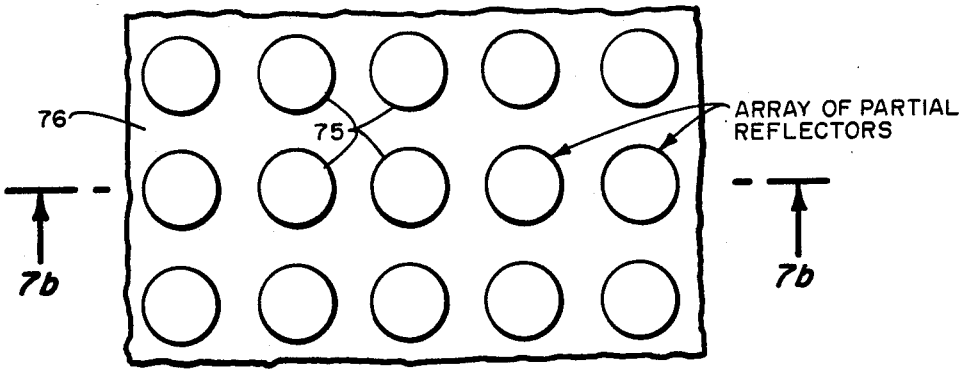
FIG. 7*a* shows a partial top planar view of typical antenna array using the microstrip backfire antenna as elements.
Figure 7B:
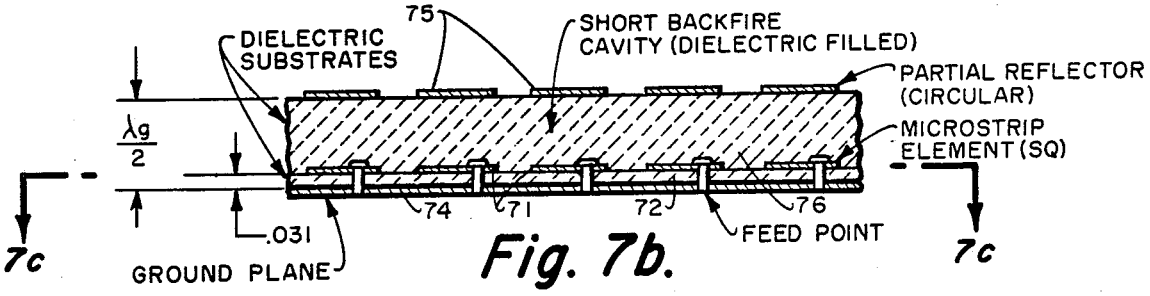
FIG. 7*b* shows a cross-sectional view taken along section line 7*b*—7*b* of FIG. 7*a*.
Figure 7C:
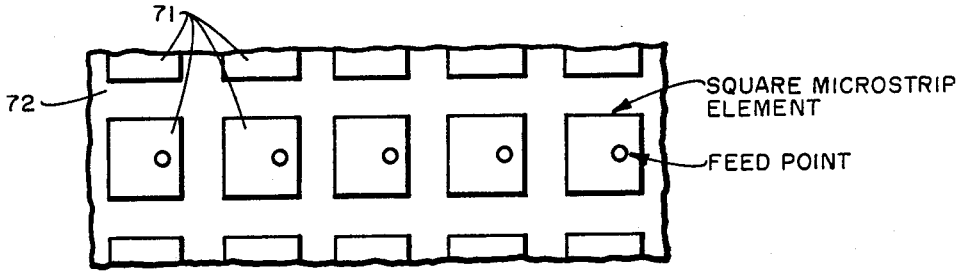
FIG. 7*c* shows a partial planar view of the bottom laminar section of the antenna array shown in FIG. 7*b* taken along line 7*c*—7*c*.

FIGS. 7*a*, 7*b* and 7*c* show a typical antenna array using a plurality of the microstrip backfire antennas. In this configuration the microstrip radiating elements 71 are printed and etched on a separate dielectric substrate board 72, as shown in FIG. 7*c*, (with the proper substrate thickness) along with the ground plane or total reflector 74, and the partial reflectors 75 are printed and etched on a separate dielectric substrate board 76 of greater thickness, as shown in FIGS. 7*a* and 7*b*. The two substrate boards (i.e., 72 and 76) are then laminated together, as shown in FIG. 7*b*, to form the final array. This provides a very inexpensive high gain array. At the higher frequencies, the thickness of the substrate boards can be made thin enough to allow conformal mounting of these arrays about missile or aircraft bodies. A total reflector coplanar with radiating elements 71, as with the antennas in FIGS. 2*a* and 3*a*, can also be used with the type antenna array shown in FIGS. 7*a*–7*c*.

The space between the coplanar total reflector and the microstrip radiating element in FIGS. 2*a* and 2*b*, and FIGS. 3*a* and 3*b* was made to be approximately 1/16 inch. The space width can be varied; however, if the coplanar total reflector is brought very near to the radiating element it will effect the electrical characteristics of the microstrip radiating element and require adjustments in the radiating element.

Obviously many modifications and variation of the present invention are possible in light of the above teachings. It is therefore to be understood that within the scope of the appended claims the invention may be practiced otherwise than as specifically described.

What is claimed is:

1. A microstrip backfire antenna comprising:

a. a thin ground plane conductor;

b. a thin microstrip radiating element spaced from said ground plane by a dielectric substrate;

c. said radiating element being fed at at least one feed point located thereon;

d. a partial reflector mounted directly above and parallel to said radiating element and ground plane at a distance of approximately one-half wavelength from said ground plane and forming a backfire cavity in the spacing between said ground plane and said partial reflector;

e. said ground plane operating as a total reflector, and said backfire cavity operating to provide multiple reflections between the partial and total reflectors of electromagnetic waves radiating from said radiating element with energy being radiated normal to and through said partial reflector.

2. A microstrip backfire antenna as in claim 1 wherein said partial reflector is approximately the same dimensions as said radiating element and said ground plane is larger than said radiating element.

3. A microstrip backfire antenna as in claim 2 wherein the shape of both the total reflector and the partial reflector are approximately the same shape and symmetrical with the shape of the radiating element to provide optimum operating conditions.

4. A microstrip backfire antenna as in claim 1 wherein said partial reflector and the total reflector formed by said ground plane are circular and the length of said radiating element is approximately equal to the diameter of said partial reflector.

5. A microstrip backfire antenna as in claim 1 wherein dielectric material fills the backfire cavity space between said total reflector and said partial reflector.

6. A microstrip backfire antenna as in claim 3 wherein said radiating element is square.

7. A microstrip backfire antenna as in claim 3 wherein said radiating element is circular.

8. A microstrip backfire antenna as in claim 4 wherein said radiating element is rectangular.

9. An antenna as in claim 1 wherein a plurality of radiating elements are used together with a plurality of partial reflectors each of which is mounted directly above a respective one of said radiating elements to form a microstrip backfire antenna array, said ground plane being larger than the array of radiating elements and operating as a common total reflector.

10. A microstrip backfire antenna array as in claim 9 wherein said plurality of partial reflectors are mounted on a dielectric material which fills the backfire cavity space between said radiating elements and said partial reflectors.

11. A microstrip backfire antenna, comprising:

a. a thin ground plane conductor;

b. a thin microstrip radiating element spaced from said ground plane by a dielectric substrate;

c. said radiating element being fed at at least one feed point located thereon;

d. a total reflector mounted on said dielectric substrate coplanar with said radiating element while spaced from and substantially completely surrounding said radiating element;

e. a partial reflector mounted directly above and parallel to said radiating element and total reflector at a distance of approximately one-half wavelength therefrom and forming a backfire cavity in the spacing between said partial reflector and said total reflector;

f. said backfire cavity operating to provide multiple reflections between the partial and total reflectors of electromagnetic waves radiating from said radiating element with energy being radiated normal to and through said partial reflector.

12. A microstrip backfire antenna as in claim 11 wherein said partial reflector is approximately the same dimensions as said radiating element.

13. A microstrip backfire antenna as in claim 12 wherein the shape of both the total reflector and the partial reflector are approximately the same shape and symmetrical with the shape of the radiating element to provide optimum operating conditions.

14. A microstrip backfire antenna as in claim 11 wherein said partial reflector and said total reflector are circular, and the length of said radiating element is approximately equal to the diameter of said partial reflector.

15. A microstrip backfire antenna as in claim 11 wherein dielectric material fills the backfire cavity space between said total reflector and said partial reflector.

16. A microstrip backfire antenna as in claim 13 wherein said radiating element is square.

17. A microstrip backfire antenna as in claim 13 wherein said radiating element is circular.

18. A microstrip backfire antenna as in claim 14 wherein said radiating element is rectangular.

19. An antenna as in claim 11 wherein a plurality of radiating elements are used together with a plurality of partial reflector each of which is mounted directly above a respective one of said radiating elements to form a microstrip backfire antenna array, said coplanar total reflector substantially surrounding the plurality of radiating elements.

20. A microstrip backfire antenna as in claim 19 wherein said plurality of partial reflectors are mounted on a dielectric material which fills the backfire cavity space between said radiating elements and said partial reflectors.

21. A microstrip backfire antenna as in claim 7 or 17 wherein the diameter of said total reflector for optimum gain is approximately two wavelengths.

22. A microstrip backfire antenna as in claims 1 or 11 wherein a dielectric support is used to mount said partial reflector above said radiating element.

* * * * *